US007963625B2

(12) United States Patent
Okada

(10) Patent No.: US 7,963,625 B2
(45) Date of Patent: Jun. 21, 2011

(54) PRINTER PROVIDING TEMPERATURE EQUALIZATION FOR PLURAL COLOR INKS

(75) Inventor: Yoshiyuki Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 55 days.

(21) Appl. No.: 12/314,160

(22) Filed: Dec. 5, 2008

(65) Prior Publication Data

US 2009/0160899 A1 Jun. 25, 2009

(30) Foreign Application Priority Data

Dec. 25, 2007 (JP) ..... 2007-332479

(51) Int. Cl.

| | |
|---|---|
| ***B41J 29/377*** | (2006.01) |
| ***B41J 29/38*** | (2006.01) |
| ***B41J 2/195*** | (2006.01) |
| ***B41J 2/045*** | (2006.01) |
| ***B41J 2/175*** | (2006.01) |
| ***B41J 2/18*** | (2006.01) |

(52) U.S. Cl. ..... 347/18; 347/6; 347/14; 347/17; 347/68; 347/85; 347/89

(58) Field of Classification Search ..... 347/6, 7, 347/14, 17, 18, 68, 85, 89

See application file for complete search history.

(56) References Cited

U.S. PATENT DOCUMENTS

| | | | | |
|---|---|---|---|---|
| 5,451,989 | A * | 9/1995 | Kadowaki et al. | 347/18 |
| 5,512,924 | A * | 4/1996 | Takada et al. | 347/18 |
| 2007/0035594 | A1 * | 2/2007 | Brooks et al. | 347/85 |
| 2009/0040249 | A1 * | 2/2009 | Wouters et al. | 347/7 |

FOREIGN PATENT DOCUMENTS

| | | |
|---|---|---|
| JP | 2004-276486 | 10/2004 |
| JP | 2006-088575 | 4/2006 |

* cited by examiner

*Primary Examiner* — Charlie Peng
*Assistant Examiner* — Hung Lam
(74) *Attorney, Agent, or Firm* — The Nath Law Group; Jerald L. Meyer; Stanley N. Protigal

(57) ABSTRACT

An inkjet printer performs printing by circulating cyan, magenta, yellow and black inks in their respective passages. The printer includes a heat exchanger which the passages enter together, and which is configured to promote the temperatures of the inks to be equal to each other.

9 Claims, 4 Drawing Sheets

| | BLACK | RED | GREEN | BLUE |
|---|---|---|---|---|
| CYAN INK | 25% | 0% | 35% | 90% |
| MAGENTA INK | 25% | 100% | 0% | 0% |
| YELLOW INK | 25% | 100% | 100% | 35% |
| BLACK INK | 100% | 0% | 0% | 0% |

PRINTER PROVIDING TEMPERATURE EQUALIZATION FOR PLURAL COLOR INKS

CROSS REFERENCE TO RELATED APPLICATION

This application is based upon and claims the benefit of priority from the prior Japanese Patent Application No. 2007-332479, filed on Dec. 25, 2007, the entire contents of which are incorporated herein by reference.

BACKGROUND OF THE INVENTION

1. Field of the Invention

The present invention relates to an ink temperature controlling mechanism of an inkjet printer, and particular to a technique for increasing an effect of cooling inks whose temperatures have become higher.

2. Description of the Related Art

As described in Japanese Unexamined Patent Publication No. 2004-276486, a temperature range for guaranteeing the ink performance is specified for an inkjet printer for the purpose of obtaining a better printing result. In general, while an inkjet printer carries out a printing operation, the inkjet printer generates heat around its inkjet head. For this reason, when the printer performs printing, the temperatures of respective inks increase. In addition, when the ambient temperature is high, the temperatures of the inks rise as well.

To avoid adverse effect of the ink temperature rise, there have been practically-used an inkjet printer of ink-circulation type including a cooler configured to cool inks with the temperatures increased due to a printing operation and the like. Such an inkjet printer of ink- circulation type which circulates inks is described in Japanese Unexamined Patent Publication No. 2006-088575. The cooler cools the inks by use of a Peltier element (device), a heat sink, a fan or the like.

Once the temperatures of inks become higher than the temperature range for guaranteeing the ink performance, the printing operation is suspended because the higher ink temperatures may cause the printer to fail to maintain the printing quality or may adversely affect the operation of the printer. For the purpose of avoiding the suspension of the printing operation, it is necessary to improve the performance of the cooler. Nevertheless, the performance improvement requires the cooler to be constructed in a larger size, or the costs to be increased. In addition, the improvement of the performance of the Peltier element increases the electric power consumption during operation.

SUMMARY OF THE INVENTION

An object of the present invention is to provide a printer of an ink-circulation type exhibiting an improved cooling effect with a simple configuration for inks heated to high temperatures.

To achieve the above object, an aspect of the present invention is an inkjet printer comprises: passages for circulation of inks of a plurality of colors at a time of printing; and a heat exchanger unit provided at portions of the passages for the inks of the plurality of colors and configured to promote temperatures of the inks of the plurality of colors to be equal to each other by exchanging heats of the inks of the plurality of colors.

According to the aspect, the effect of cooling inks whose temperatures become higher can be improved. This is because, when the temperature becomes higher in one ink, the heat exchanger moves the heat to the other inks, and thus makes the temperature equal throughout the inks.

The plurality of colors may be cyan, magenta, yellow and black, and the heat exchanger unit may have a structure in which the passage for black ink is interposed between the passage for magenta ink and the passage for yellow ink.

The magenta ink and the yellow ink are often used simultaneously whereas the black ink is rarely used with these inks simultaneously. For this reason, when the printer is configured such that the passage for the black ink is interposed between the passage for the magenta ink and the passage for the yellow ink as in the foregoing configuration, the heat exchanger unit can diffuse the heat efficiently.

The plurality of colors may be cyan, magenta, yellow and black, the passage for black ink may be bifurcated into two passages for the black ink before entering the heat exchanger unit, and the two bifurcated passages for the black ink may be arranged in the heat exchanger unit such that the passage for magenta ink, the passage for yellow ink and the passage for cyan ink are not located next to each other.

The temperature of the black ink rarely rises together with the temperatures of the color inks simultaneously. Accordingly, as in the foregoing configuration, the two passages for the black ink are arranged in such a way as to avoid placing, next to each other, the passage for the magenta ink, the passage for the yellow ink and the passage for the cyan ink. This allows the exchanger unit to diffuse the heat efficiently.

The heat exchanger unit may comprise at least one of a Peltier element and a heat sink.

The foregoing configuration makes it possible for the heat exchanger unit to have a cooling capability.

The plurality of colors may be cyan, magenta and yellow and black, and the passage for magenta ink, the passage for yellow ink and the passage for cyan ink may be arranged around the passage for black ink in the heat exchanger unit.

The temperature of the black ink rarely rises together with the temperatures of the color inks simultaneously. Accordingly, as in the foregoing configuration, the passage for the magenta ink, the passage for the yellow ink and the passage for the cyan ink are arranged around the passage for the black ink. This allows the heat exchanger unit to diffuse the heat efficiently.

According the foregoing configurations, an inkjet printer of ink-circulation type can exert an improved cooling effect on the inks heated to high temperatures with a simple configuration.

DETAILED DESCRIPTION OF THE EMBODIMENT

Figure 1:
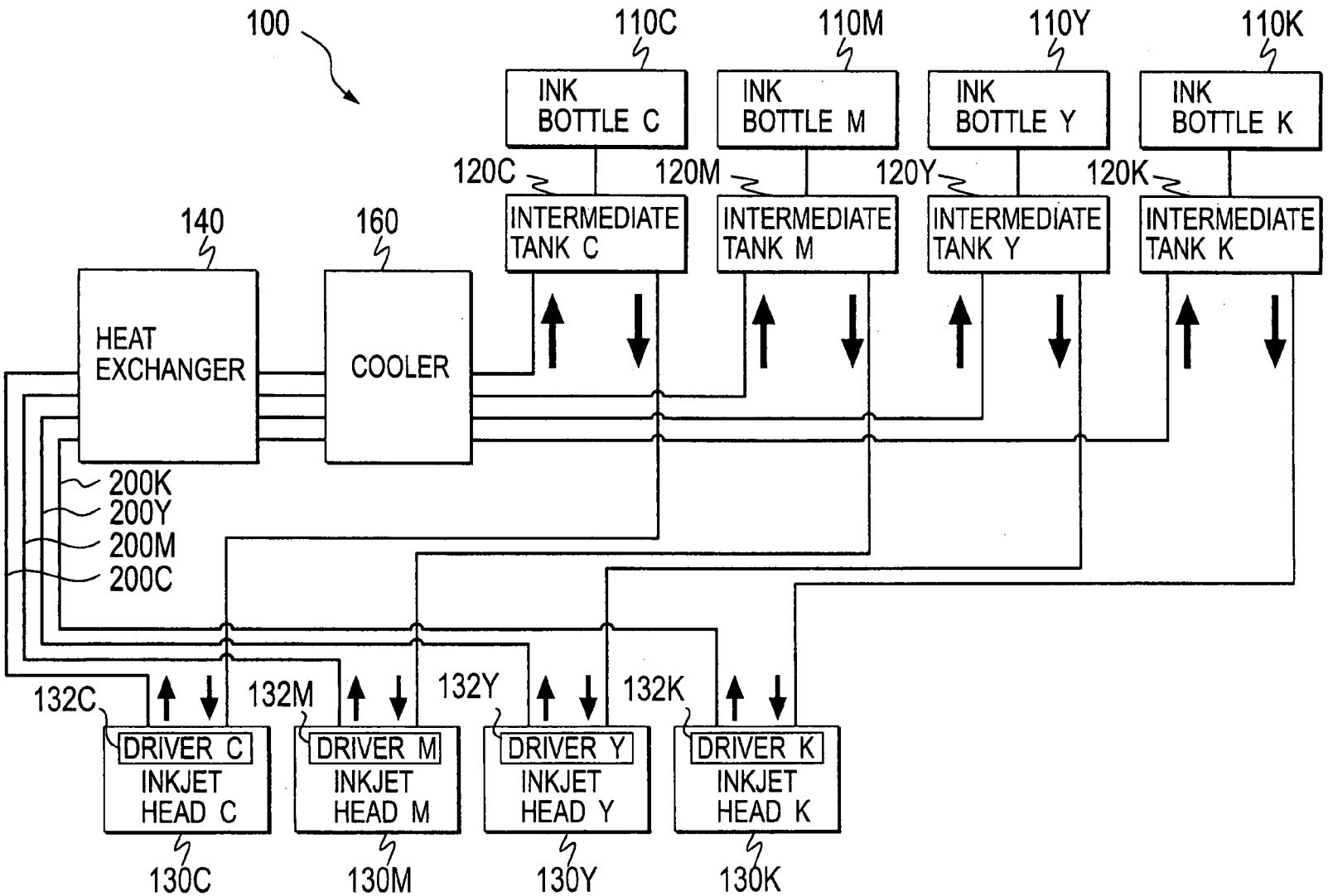
FIG. 1 is block diagram for explaining ink passages in an inkjet printer according to an embodiment of the present invention.

Descriptions will be provided hereinbelow for an embodiment of the present invention on the basis of the drawings. While the following drawings are described, the same or similar components will be denoted by the same or similar reference numerals. As shown in FIG. 1, an inkjet printer 100 is a color printer configured to carry out a printing operation by use of four color inks including CMYK (cyan, magenta, yellow and black) ink. Each color ink is designed to be supplied from its corresponding detachable ink bottle. The inkjet printer 100 includes ink bottles 110C, 110M, 110Y and 110K configured to supply the cyan ink, the magenta ink, the yellow ink, and the black ink, respectively.

The inks supplied from the ink bottles are reserved in intermediary tanks for the time being, respectively. To this end, the inkjet printer 100 includes intermediary tanks 120C, 120M, 120Y and 120K configured to reserve the cyan ink, the magenta ink, the yellow ink, and the black ink, respectively.

The inks reserved in the respective intermediary tanks 120C, 120M, 120Y and 120K are sent to inkjet heads each including multiple nozzles from which the corresponding ink is ejected, and thus is used for a printing operation. As shown in FIG. 1, the inkjet printer 100 includes inkjet heads 130C, 130M, 130Y and 130K which eject the cyan ink, the magenta ink, the yellow ink and the black ink, respectively. In the present embodiment, it is assumed that inkjet heads of a type from which an ink is ejected by use of a piezoelectric element are used.

The inkjet heads 130C, 130M, 130Y and 130K include drivers 132C, 132M, 132Y and 132K configured to drive piezoelectric elements on the basis of driving signals sent through signal lines, which are not illustrated, respectively. The inkjet printer 100 is of an ink-circulation type which circulates the ink. Inks which the inkjet heads 130 do not consume for a printing operation are returned to the intermediary tanks 120, respectively. The passages for the inks are each formed of a resin-made pipe, a metal-made pipe or the like.

The drivers 132 and the piezoelectric elements generate heat through their operations, respectively. For the purpose of checking the influence of the rise in the temperatures of the inks due to this heat generation and the Joule heat, the inkjet printer includes a cooler 160 configured to cool the inks. Inks which the inkjet heads 130 do not consume for a printing operation are cooled by the cooler 160, and are thus returned to the intermediary tanks 120, respectively.

Figures 2, 3:
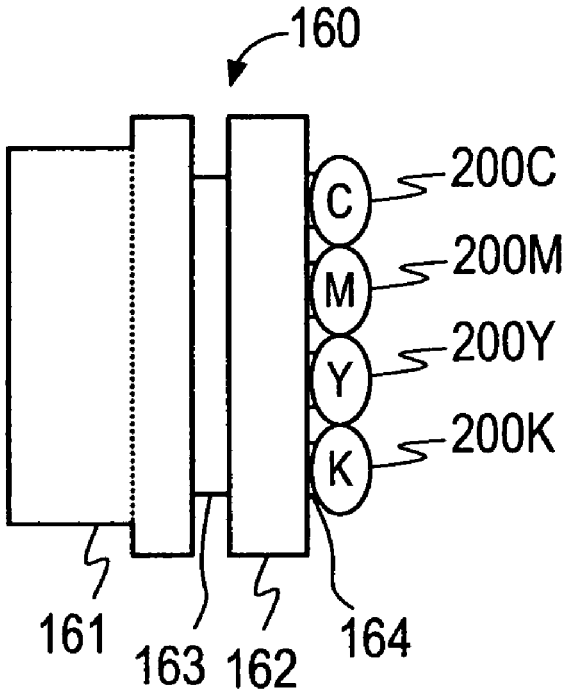
FIG. 2 is a diagram showing a configuration of a cooler according to the embodiment of the present invention.
FIG. 3 is a table showing representative colors and an example of the percentages of the ink amounts ejected from the ink jet head to express the representative colors.

FIG. 2 is a diagram showing a configuration of the cooler 160. As shown in FIG. 2, the cooler 160 is arranged in such a way as to contact pipes 200C, 200M, 200Y and 200K which serve as the ink passages. The cooler 160 includes: an aluminum-made base part 162 disposed closest to the pipes 200C, 200M, 200Y and 200K; a Peltier element 163 configured to cool the base part 162 with an electric current; and a heat sink 161. A heat conductive grease 164 is applied to an interstice between the base part 162 and each of the pipes 200C, 200M, 200Y and 200K, and thus facilitates heat conduction in the interstice. The heat conductive grease 164 may be applied to an interstice between each neighboring two of the pipes 200C, 200M, 200Y and 200K. For the purpose of enhancing the cooling effect, a fan may be additionally provided so as to blow a wind to the cooler 160. In addition, when the temperatures of the respective inks are low, the cooler 160 can be used as a heater by applying a reverse current to the Peltier element 163.

See FIG. 1 once again. In the present embodiment, the inkjet printer 100 further includes a heat exchanger 140. The pipes 200C, 200M, 200Y and 200K passing the heat exchanger 140 are guided to the cooler 160. The pipes 200C, 200M, 200Y and 200K respectively serving as the ink passages comes together into the heat exchanger 140, which makes the temperatures of the inks equal to each other. The heat exchanger 140 may be formed by use of a material with higher heat conductivity, for example by use of copper. The pipes 200C, 200M, 200Y and 200K pass the heat exchanger 140 and, therefore the temperatures of the inks are made equal to each other. Thereby, the heat exchanger 140 enhances the effect of cooler 160 for cooling inks heated to high temperatures.

The temperatures of the inks in the inkjet heads 130C, 130M, 130Y and 130K rise due to heats generated by operations of the drivers 132C, 132M, 132Y and 132K and the piezoelectric elements, respectively. For this reason, as an area coverage in a page becomes higher, the temperatures of the inks increase. Therefore, the temperatures of the inks do not rise uniformly. Depending on contents to be printed, the temperatures of the inks rise differently from each other.

FIG. 3 is a table showing representative colors and an example of percentages of ink amounts ejected from the respective inkjet heads 130 to express the representative colors. In this table, a percentage for each color ink is not a fraction of a total amount of all the inks ejected from the inkjet heads 130 when the total amount is set as 100%. Instead, an ink ejection amount for each color is expressed in percentage with respect to a value of maximum ink amount ejected from the inkjet head 130 when the maximum ink amount is set as 100%.

As learned from FIG. 3, when solid black is printed, the black ink is ejected at 100% of its maximum ejection amount, and the cyan, magenta and yellow inks are ejected at 25% of its maximum ejection amount. For this reason, the temperature of the black ink rises to a relatively large extent whereas the temperatures of the cyan, magenta and yellow inks do not rise so much. When solid green is printed, the cyan ink is ejected at 35% of its maximum ejection amount, and the yellow ink is ejected at 100% of its maximum ejection amount. For this reason, the temperature of the yellow ink rises to a relatively large extent. When solid blue is printed, similarly, the temperature of the cyan ink rises to a relatively large extent. By contrast, when solid red is printed, the magenta ink and the yellow ink are ejected at 100% of their respective maximum ejection amounts. For this reason, the temperatures of the magenta ink and the yellow ink rise to a relatively large extent.

With this taken into consideration, one may consider that the temperatures of the magenta ink and the yellow ink relatively often rise simultaneously. For this reason, for the purpose of causing the heat exchanger to diffuse the heat efficiently, one may consider the pipe 200M for the magenta ink and the pipe 200Y for the yellow ink should preferably be arranged away from each other.

Moreover, it is probably rare that the ejection amount of the black ink simultaneously increases together with the ejection amounts of color inks such as cyan, magenta, and yellow inks. For this reason, one may consider that, when the temperature of the black ink rises to a large extent, the temperatures of the respective color inks rise to a small extent, and that, when the temperatures of the respective color inks rise to a large extent, the temperature of the black ink rises to a small extent.

Figure 4:
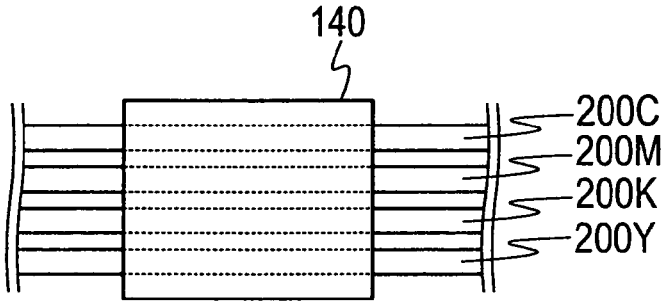
FIG. 4 is a diagram showing an example of a heat exchanger and pipes for the inks in the heat exchanger according to the embodiment of the present invention.

Judging from the foregoing discussion, it may be desirable that the pipe 200K for the black ink be arranged between the pipe 200M for the magenta ink and the pipe 200Y for the yellow ink from a viewpoint of the equal heat diffusion. Specifically, in the heat exchanger 140, it is desirable that, as shown in FIG. 4, the pipe 200C for the cyan ink, the pipe 200M for the magenta ink, the pipe 200K for the black ink and the pipe 200Y for the yellow ink should be arranged in this sequence. Otherwise, the pipe 200M for the magenta ink, the pipe 200K for the black ink, the pipe 200Y for the yellow ink and the pipe 200C for the cyan ink may be arranged in this sequence.

Figure 5:
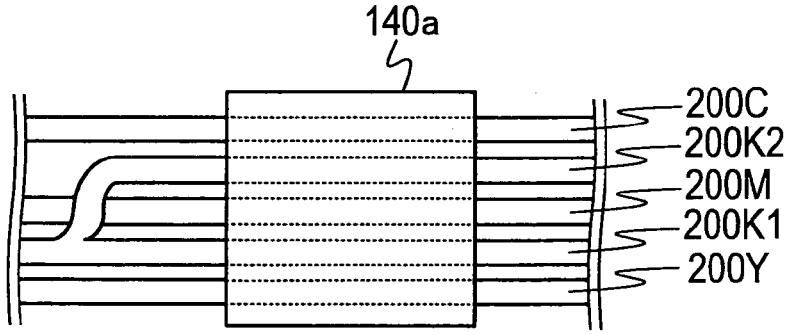
FIG. 5 is a diagram showing another example of the heat exchanger and the pipes for the inks in the heat exchanger according to the embodiment of the present invention.

Furthermore, for the purpose of avoiding arranging the pipes for the color inks (the cyan ink, the magenta ink and the yellow ink) next to each other, as shown in FIG. 5, the pipe for the black ink may be bifurcated into two pipes 200K1 and 200K2 before the pipe for the black ink enters the heat exchanger 140*a* so that the pipe 200C for the cyan ink, the pipe 200K2 for the black ink, the pipe 200M for the magenta ink, the pipe 200K1 for the black ink and the pipe 200Y for the yellow ink are arranged in this sequence. This arrangement further facilitates the equal heat diffusion. It goes without saying that the pipes for the color inks may be arranged in other pattern. The bifurcated pipes 200K1 and 200K2 for the black ink are joined together after passing the heat exchanger 140*a* or the cooler 160.

Figure 6:
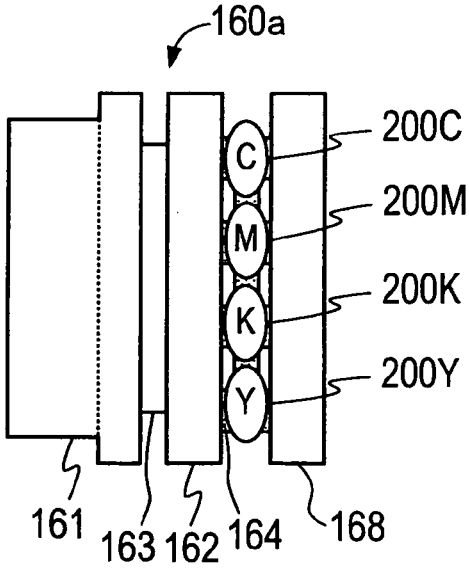
FIG. 6 is a diagram showing a configuration of a cooler which functions as a heat exchanger according to the embodiment of the present invention.

Instead of the heat exchanger 140 being provided independently, the heat exchanger and the cooler may be integrated into one unit. FIG. 6 shows an example of a cooler 160*a* which additionally functions as a heat exchanger. The cooler 160*a* shown in FIG. 6 further includes an aluminum-made base part 168 which is located at the side of the pipes 200 in addition to the components included in the cooler 160 shown in FIG. 2. The cooler 160*a* has a configuration in which the pipes 200C, 200M, 200Y and 200K are interposed between the base part 162 and the base part 168. Moreover, the heat conductive grease 164 is applied to interstices among the pipes 200, the base part 162 and the base part 168 for the purpose of facilitating the heat conduction among the pipes 200, the base part 162 and the base part 168.

In the case, from a viewpoint of the equal heat diffusion, the cooler 160*a* employs the arrangement scheme with which the pipe 200K for the black ink is interposed between the pipe 200M for the magenta ink and the pipe 200Y for the yellow ink, too. Thus, in the cooler 160*a*, the pipe 200C for the cyan ink, the pipe 200M for the magenta ink, the pipe 200K for the black ink and the pipe 200Y for the yellow ink are arranged in this sequence.

Figure 7:
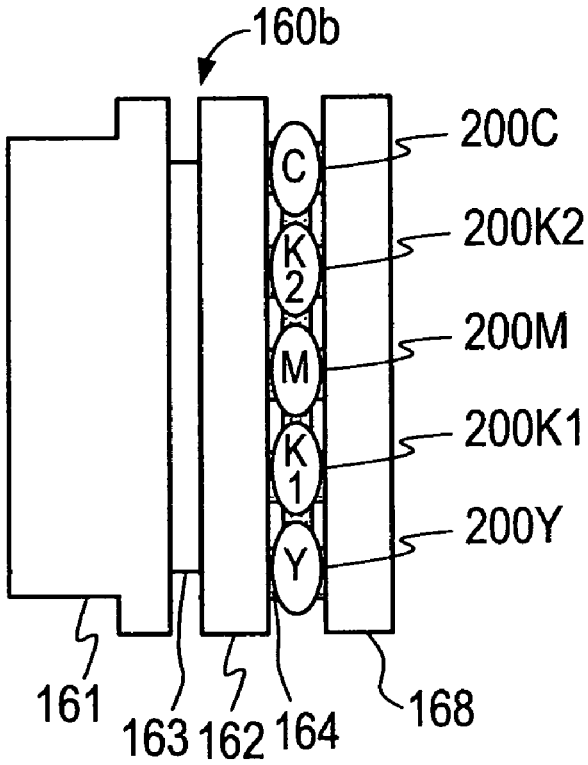
FIG. 7 is a diagram showing another configuration of the cooler which function as the heat exchanger according to the embodiment of the present invention.

Furthermore, as shown in FIG. 7, the pipe for the black ink may be bifurcated into two pipes 200K1 and 200K2 before the pipe for the black ink enters the cooler 160*b* so that the pipe 200C for the cyan ink, the pipe 200K2 for the black ink, the pipe 200M for the magenta ink, the pipe 200K1 for the black ink and the pipe 200Y for the yellow ink are arranged in this sequence. This arrangement further facilitates the equal heat diffusion. It goes without saying that the pipes for the color inks are arranged may be arranged in other pattern. The bifurcated pipes 200K1 and 200K2 for the black ink are joined together after passing the cooler 160*b*.

Figure 8:
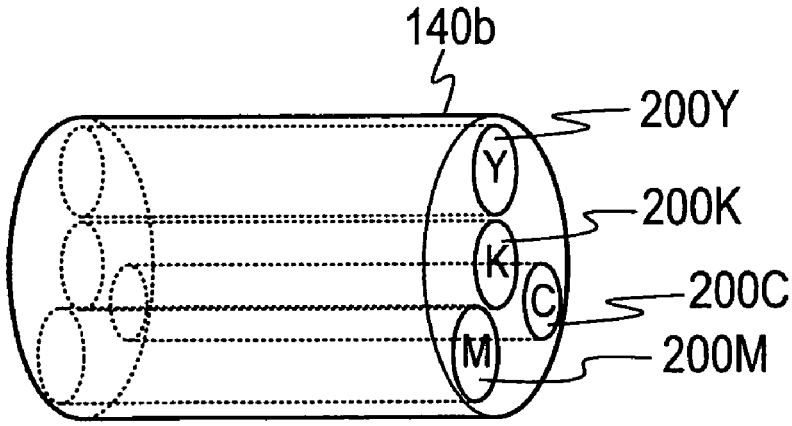
FIG. 8 is a diagram showing another shape of the heat exchanger according to the embodiment of the present invention.

FIG. 8 is a diagram showing another shape of the heat exchanger. A heat exchanger 140*b* shown in FIG. 8 is cylindrical in shape. The pipe 200K for the black ink is arranged in the center of the heat exchanger 140*b*. The pipe 200C for the cyan pipe, the pipe 200M for the magenta ink and the pipe 200Y for the yellow ink are arranged around the pipe 200K for the black ink, and are arranged a certain distance away from each other. One may consider that the temperatures of the respective color inks rise to a small extent when the temperature of the black ink rises to a large extent, and the temperature of the black ink rises to a small extent when the temperatures of the respective color inks rise to a large extent. The equal heat diffusion is facilitated more by the arrangement of the pipe 200K for the black ink in the center of the heat exchanger 140*b* and the arrangement of the pipes 200C, 200M and 200Y around the pipe 200K. Note that the shape of the heat exchanger 140*b* is not limited to the cylindrical shape.

The printer according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. An inkjet printer comprising:

a plurality of inkjet heads;

passages for circulation of inks of a plurality of colors at a time of printing, and connected to the inkjet heads; and a heat exchanger unit provided at portions of the passages for the inks of the plurality of colors and configured to promote temperatures of the inks of the plurality of colors to be equal to each other by exchanging heats of different colors among the inks of the plurality of colors.

2. The printer according to claim 1, wherein the plurality of colors are cyan, magenta, yellow and black, and the heat exchanger unit has a structure in which the passage for black ink is interposed between the passage for magenta ink and the passage for yellow ink.

3. The printer according to claim 1, wherein the plurality of colors are cyan, magenta, yellow and black, the passage for black ink is bifurcated into two passages for the black ink before entering the heat exchanger unit, and the two bifurcated passages for the black ink are arranged in the heat exchanger unit such that the passage for magenta ink, the passage for yellow ink and the passage for cyan ink are not located next to each other.

4. The printer according to claim 1, wherein the heat exchanger unit comprises at least one of a Peltier element and a heat sink.

5. The printer according to claim 1, wherein the plurality of colors are cyan, magenta and yellow and black, and the passage for magenta ink, the passage for yellow ink and the passage for cyan ink are arranged around the passage for black ink in the heat exchanger unit.

6. The printer according to claim 1, wherein heat from the inkjet heads results in differential heating of inks of one or more colors to a relatively larger extent as compared to ink of at least one different color, sufficiently to cause, absent thermal control, temperatures of at least one ink to increase to a relatively large extent, and the heat exchanger unit is configured to promote the temperatures of the inks of the plurality of colors to be equal to each other by exchanging heat of at least one ink having a temperature larger than temperatures of the other inks and heat of at least one of the other' inks between the portions of the passages thereof.

7. The printer according to claim 6, wherein the passages for circulation of inks of the plurality of colors at a time of printing cause inks which the inkjet heads do not consume for a printing operation to return to intermediary tanks; and the heat exchanger unit controls the temperature of the inks to be returned to the intermediary tanks.

8. The printer according to claim 6, wherein the passages for circulation of inks of the plurality of colors at a time of printing cause inks which the inkjet heads do not consume for a printing operation to return to intermediary tanks; and the heat exchanger unit comprises at least one of a Peltier element and a heat sink, and controls the temperature of the inks to be returned to the intermediary tanks.

9. The printer according to claim 1, wherein the inks of the plurality of colors include black ink provided as one of the plurality of colors, and the heat exchanger unit has a structure which interposes the passage for black ink between the passages for at least two of the other colors.

* * * * *